US006190770B1

(12) United States Patent
Jang et al.

(10) Patent No.: US 6,190,770 B1
(45) Date of Patent: Feb. 20, 2001

(54) PULSED VOLTAGE SURGE RESISTANT ENAMELLED WIRES

(75) Inventors: Chih-Min Jang, Taipei; Ru-Shi Liu, Hsinchu Hsien; Chi-Ting Du; Tsair-Shyang Huang, both of Taipei; Yao-Chung Tu, Hsinchu; Wen-Hsiung Liu, Taipei; Wen-Cheng Wu, Taipei Hsien; Tsen-Hsu Lin, Hsinchu, all of (TW)

(73) Assignee: Tai-I Electric Wire & Cable Co., Taipei (TW)

( * ) Notice: Under 35 U.S.C. 154(b), the term of this patent shall be extended for 0 days.

(21) Appl. No.: 09/329,601

(22) Filed: Jun. 10, 1999

(30) Foreign Application Priority Data

Feb. 12, 1999 (TW) ..... 88102280

(51) Int. Cl.[7] ..... D02G 3/00; H01B 7/00

(52) U.S. Cl. ..... 428/372; 428/375; 428/379; 428/383; 428/389; 174/110 A; 174/110 SR

(58) Field of Search ..... 174/110 A, 110 SR; 428/372, 379, 383, 375, 389

(56) References Cited

U.S. PATENT DOCUMENTS

| | | | | |
|---|---|---|---|---|
| 2,495,630 | * | 1/1950 | Dorst | 428/379 |
| 2,700,212 | * | 1/1955 | Flynn et al. | 428/379 |
| 3,109,053 | * | 10/1963 | Ahearn | 428/379 |
| 3,936,572 | * | 2/1976 | MacKenzie, Jr. et al. | 428/379 |
| 4,493,873 | * | 1/1985 | Keane et al. | 428/372 |
| 4,503,124 | * | 3/1985 | Keane et al. | 428/372 |
| 4,620,086 | * | 10/1986 | Ades et al. | 219/552 |
| 5,091,609 | * | 2/1992 | Sawada et al. | 174/110 A |
| 5,106,667 | * | 4/1992 | Ochsner et al. | 428/379 |
| 5,468,557 | * | 11/1995 | Nishio et al. | 428/384 |
| 5,654,095 | | 8/1997 | Yin et al. | 428/372 |
| 5,834,117 | * | 11/1998 | Onishi | 428/379 |
| 5,917,155 | * | 6/1999 | Hake et al. | 174/120 R |

* cited by examiner

*Primary Examiner*—William Krynski
*Assistant Examiner*—J. M. Gray
(74) *Attorney, Agent, or Firm*—Ladas & Parry

(57) ABSTRACT

A pulsed voltage surges resistant enamelled wire comprises a metal conductive wire and at least one shield layer outside the wire, the at least one shield layer is provided by a coating composition comprising (a) a synthetic resin, (b) an organic solvent and (c) α-form $Al_2O_3$ particles and γ-form $Al_2O_3$ particles.

12 Claims, No Drawings

PULSED VOLTAGE SURGE RESISTANT ENAMELLED WIRES

BACKGROUND OF THE INVENTION

It is known that conventional types of speed drives cannot meet the requirements of efficiency, exactness and cost because of their high installation cost, smaller torque at slow speed, high maintenance cost and high energy consumption. Through pulse width modulated (PWM) type of inverters can meet the aforementioned requirements, it has been found that the use of PWM inverters causes premature failure of enamelled wires because of the inverters' high peak voltage values, pulsed voltage surges and harmonics, boost up and down, and high switching frequencies. Specifically, pulsed voltage surges arise within a very short time, measured in microseconds, which causes the temperature to suddenly increase (e.g. the effect of pulse voltage surges on temperature is more greater that of cornea discharge). The sudden increase of temperature causes thermal-oxidation decomposition of the insulation coating layers on enamelled wires and shortens the life of the wires.

U.S. Pat. No. 5,654,095 discloses a pulsed voltage surge resistant enamelled wire which can withstand voltage surges approaching 3000 volts and is resistant to high temperatures up to 300° C., where the rate of voltage increase greater than 100 kV/$\mu$sec and the frequency is less than 20 kHZ. The enamelled wire of U.S. Pat. No. 5,654,095 is characterized by the addition of metal oxide particles having a particle size of from 0.05 to 1 micron to the shield layer of enamelled wire to provide the desired pulse voltage surge resistant. According to U.S. Pat. No. 5,654,095, metal oxides which can effectively resist pulse voltage surges and increase the lifetime of enamelled wires include titanium dioxide, alumina, silica, zirconium oxide, zinc oxide, iron oxide and various naturally occurring clays such as those listed in column 4, lines 57–59. Though the examples of U.S. Pat. No. 5,654,095 disclose that the metal oxide as $Al_2O_3$, they are totally silent on the structure of that $Al_2O_3$.

There are two major structural types of $Al_2O_3$—$\alpha$-form and $\gamma$-form. $\alpha$-form is a trigonal (R-3CH) structure wherein the lattice constants a=b=4.8 Å and c=13.0 Å, the lattice angles $\alpha=\beta=90°$ and $\gamma=120°$. $\gamma$-form is a cubic (Fd-3mS) structure wherein the lattice constants a=b=c=7.9 Å and the lattice angles $\alpha=\beta=\gamma=90°$. The structure of $\alpha$-form $Al_2O_3$ is more compact than that of $\gamma$-form. In other words, the structure of $\gamma$-form $Al_2O_3$ is closer to an amorphous phase and is significantly different from that of a $\alpha$-form.

It has been found that, in the shield layer(s) of an enamelled wire, the use of both $\alpha$-form $Al_2O_3$ particles and $\gamma$-form $Al_2O_3$ particles can provide pulse voltage surge resistance that is much better than that provided by $\alpha$-form $Al_2O_3$ particles or $\gamma$-form $Al_2O_3$ particles alone.

SUMMARY OF THE INVENTION

It is therefore an object of the invention to provide an enamelled wire which has increased resistance to insulation degradation caused by pulsed voltage surges.

In accordance with the invention, a pulsed voltage surge resistant enamelled wire comprises metal wire and at least one pulsed voltage surge shield layer overlaying the metal wire. The shield layer is provided by at least one polymer having $\alpha$-form $Al_2O_3$ particles and $\gamma$-form $Al_2O_3$ particles dispersed therein. The shield layer containing $\alpha$-form $Al_2O_3$ particles and $\gamma$-form $Al_2O_3$ particles renders the enamelled wire resistant to pulsed voltage surges without impairing the other properties of the enamelled wire.

These and other objects, advantages and features of the present invention will be more fully understood and appreciated by reference to the written specification.

DETAILED DESCRIPTION OF THE INVENTION

The present invention provides an enamelled wire which comprises a metal wire and at least one coating layer outside the wire. The wire may have multiple coating layers with various respective components, so long as at least one outside coating layer contains $\alpha$-form $Al_2O_3$ particles and $\gamma$-form $Al_2O_3$ particles. In other words, if the enamelled wire comprises a single outside coating layer, the single outside coating layer is the shield layer which contains $\alpha$-form $Al_2O_3$ particles and $\gamma$-form $Al_2O_3$ particles. Otherwise at least one of the outside coating layers is the shield layer which contains both $\alpha$-form $Al_2O_3$ particles and $\gamma$-form $Al_2O_3$ particles. The shield layer may contain from 1:1 to 1:100 $\alpha$-form to $\gamma$-form particles. Preferably the range is from 1:5 to 1:50, and more preferably the range is from 1:5 to 1:15.

The metal wire of the present invention can have any shape, but generally is circular or rectangular in form. If circular, it is preferred that the diameter of the wire be from 0.05 to 3.2 mm more preferably from 0.10 to 1.5 mm, and most preferably from 0.35 to 1.2 mm.

Each shield coating layer of the present invention is provided by a coating composition comprising (a) a synthetic resin and (b) an organic solvent. The synthetic resin and organic solvent for each coating layer can be identical or different. The coating composition may optionally comprise other conventional components suitable for coating layers of an enamelled wire such as dyes, pigments, dispersants, and the like. The selected optional components and their amounts should not affect the desired properties of the coating layer. Any synthetic resins conventionally used in enamelled wires can be used in the coating composition. The synthetic resins used in the present invention can be, but are not limited to, modified or unmodified, polyacetal, polyurethane, polyester, polyesterimide, polyesterimine, polyimine polyamideimide, polyamide, polysulfone, polyimide resins, or mixtures thereof. The selection of the synthetic resin depends on the required temperature resistance and insulation properties required of the coating layers. Furthermore, persons skilled in the art can choose an organic solvent suitable to the selected synthetic resin. The organic solvent can be, but is not limited to, cresols, hydrocarbons, dimethyl phenol, toluene, xylene, ethylbenzene, N,N-dimethyl formamide (DMF), N-methylpyrrolidone (NMP), esters, ketones, or mixtures thereof. The combination of the synthetic resin and the organic solvent is, based on the total weight of the synthetic resin and the organic solvent, from 20 to 80 wt % synthetic resin and from 20 to 80 wt % organic solvent, and more preferably from 25 to 75 wt % synthetic resin and from 75 to 25 wt % organic solvent.

In order to provide the desired pulse voltage surge resistance, at least one of the outside coating layer(s) of the enamelled wire of the present invention must be a shield layer provided by a coating containing α-form $Al_2O_3$ particles and γ-form $Al_2O_3$ particles. It is preferred that the total amount of $Al_2O_3$ particles, including α-form $Al_2O_3$ particles and γ-form $Al_2O_3$ particles, based on 100 parts by weight of synthetic resin, be from 3 to 20 parts by weight (3 to 20 PHR), and more preferably from 5 to 15 parts by weight (5 to 15 PHR). The particle size of $Al_2O_3$ particles suitable for the present invention is from 0.001 to 10 microns, preferably from 0.01 to 5 microns, and more preferably from 0.05 to 1.0 micron. $Al_{2\ O3}$ particles can be uniformly dispersed into the coating composition by high shear mixing or with the use of other mixing apparatus. Optionally, a dispersant can be used to facilitate the dispersion of $Al_2O_3$ particles and prevent the particles from precipitating. The amount of dispersant, if used, is from 0.01 to 2 parts by weight per hundred parts by weight of the synthetic resin and organic solvent.

Each of the coating layer(s) of the enamelled wire is provided by applying a corresponding coating composition on the metal wire, and then drying and curing the coating composition. Generally, the thickness of each layer is from 2.0 to 5.0 mils and the layer is provided by repeatedly applying the coating composition on the surface of the wire in five (5) to fifteen (15) passes. The method of applying the coating depends on the viscosity of the coating composition. Generally, at 30° C., a coating composition having a viscosity higher than 500 cps is applied by dies, a coating composition having a viscosity of from 100 to 200 cps is applied by a roller and a coating composition having a viscosity of from 40 to 100 cps is applied by felt. The speed for applying the coating composition is between 3 and 450 m/min. The coated wire, after each coating layer has been applied, is fed into a furnace to dry and cure the layer. The temperature of furnace will depend on the type of coating, the length of furnace and the thickness of coating layer. Generally, the temperature at the inlet of the furnace is between 300 and 350° C. and the temperature at the outlet of the furnace is between 350 and 700° C.

The following examples are offered by way of illustration. In these examples, the formulations of coatings and $Al_2O_3$ particles applied are as follows:

(1) PAI coating: polyamideimide coating, available from Tai-I Electric Wire & Cable Co,. Ltd. ROC. as TAI-AIW-31.5, which can be cured by heating at an elevated temperature. The solvent of the coating comprises xylene, NMP and DMF, viscosity: 1500 cps/ 30° C., solid content: 30.2%.

(2) PEI coating: polyesterimide coating, available from Nisshoku-Schenectady Kagaku Co. Ltd. Japan as ISOMID-42, which can be cured by heating at an elevated temperature, and through a transesterification or esterification reaction. The solvent of the coating comprises xylene, hydrocarbons, cresols and phenol, viscosity: 2050 cps/30° C., solid contents: 42.2%.

(3) $Al_2O_3$ particles: α-form particles and γ-form particles, particle size of α-form: about 0.3 micron, particle size of γ-form: about 0.05 micron.

EXAMPLES

Comparative Example C1

PEI and PAI coatings were separately applied by dies onto the surface of copper wires having a diameter of 1.024 mm under the following conditions:

(i) inner coating layer (the coating layer directly attached to the copper wire):

coating: PEI coating coating passes: nine (9) passes linear coating speed: 9 m/min (ii) outer coating layer (the coating layer overlapping the inner coating layer):

coating: PAI coating coating passes: three (3) passes linear coating speed: 9 m/min (iii) furnace: length=3.5 m, inlet temperature=360° C., outlet temperature=480° C.

The properties of the coated wires are shown in Table I.

Comparative Examples C2

The same as Comparative Example C1 with the exception that 5–10% α-form $Al_2O_3$ particles, based on the weight of the synthetic resin, were added to the PAI coating and the $Al_2O_3$ particle-containing PAI coating were mixed at a high stirring speed. The properties of the coated wires are shown in Table I.

Comparative Example C3

The same as Comparative Example C1 with the exception that 5–10% γ-form $Al_2O_3$ particles, based on the weight of the synthetic resin, were added to the PAI coating and the $Al_2O_3$ particle-containing PAI coatings were mixed at a high stirring speed. The properties of the coated wires are shown in Table I.

EXAMPLES

The same as Comparative Example 1 with the exception that 5–10% α-form $Al_2O_3$ particles (α-form/γ-form=⅓), based on the weight of synthetic resin, were added to the PAI coating and the $Al_2O_3$ particle-containing PAI coating were mixed at a high stirring speed. The properties of the coated wires are shown in Table I.

TABLE I

| Ex. | $Al_2O_3$ in upper layer | flexibility | adherence | dielectric (kV) | elongation (%) | softening temp. (° C.) | heat shock(1) | lifetime(2) (Hr) |
|---|---|---|---|---|---|---|---|---|
| C1 | none | good | good | 8.86 | 33.5 | 402 | good | 39.4 |
| C2 | α-$Al_2O_3$ | good | good | 8.69 | 32.5 | 407 | good | 23.8 |

TABLE I-continued

| Ex. | $Al_2O_3$ in upper layer | flexibility | adherence | dielectric (kV) | elongation (%) | softening temp. (° C.) | heat shock[1] | lifetime[2] (Hr) |
|---|---|---|---|---|---|---|---|---|
| C3 | $\gamma$-$Al_2O_3$ | good | good | 9.53 | 32 | 419 | good | 41 |
| 1 | $(\alpha + \gamma)Al_2O_3$ | good | good | 8.92 | 33 | 412 | good | 194.8 |

Note.
[1]The heat shock test was conducted at 200° C. for one (1) hour according to the NEMA MW-35C standards, wherein the enamelled wires were tested, after having been wound around a mandrel having a diameter three times the diameter of the enamelled wires.
[2]The pulsed voltage surge life expectancy was tested as follows:
(i) a twisted pair of enamelled wires was subjected to the test at a load of 1364 g and each wire pair was twisted through eight (8) revolutions;
(ii) one end of the wire was connected to the output of a frequency inverter and the other end to a three-phase, 3 HP induction motor; the inverter supplied the motor of 380 V through 100 m of the wire at a main frequency of 60 Hz, at a peak value of 537 V. The connecting point between the wire and the generator, as in a 195° C. constant-temperature oven.

As shown in Table I, the pulsed voltage surge, life expectancy of the enamelled wires of the present invention wherein the shield layer contains both $\alpha$-form $Al_2O_3$ particles and $\gamma$-form $Al_2O_3$ particles is much higher than that of the enamelled wires wherein the shield layer contains $\alpha$-form $Al_2O_3$ particles or contains $\gamma$-form $Al_2O_3$ particles.

While particular embodiments of the present invention have been illustrated and described, it would be obvious to those skilled in the art that various other changes and modifications can be made without departing from the spirit and scope of the invention. It is The invention is defined by the appended claims.

What is claimed is:

1. A pulsed voltage surge resistant enamelled wire comprising:

a conductive wire; and at least one coating layer outside the wire containing $\alpha$-form $Al_2O_3$ particles and $\gamma$-form $Al_2O_3$ particles in a ratio of $\alpha$-form $Al_2O_3$ particles to $\gamma$-form $Al_2O_3$ particles of from 1:1 to 1:100.

2. The enamelled wire according to claim 1, wherein the shield layer is provided by a coating composition comprising (a) a synthetic resin, (b) an organic solvent and (c) $\alpha$-form $Al_2O_3$ particles and $\gamma$-form $Al_2O_3$ particles.

3. The enamelled wire according to claim 2, wherein the coating composition comprises from 3 to 20 parts by weight of $Al_2O_3$ particles per hundred parts by weight of the synthetic resin.

4. The enamelled wire according to claim 3, wherein the coating composition comprises from 5 to 15 parts by weight of $Al_2$ $O_3$ particles per hundred parts by weight of the synthetic resin.

5. The enamelled wire according to claim 4, wherein the ratio between the $\alpha$-form $Al_2O_3$ particles and the $\gamma$-form $Al_2O_3$ particles is 1:9.

6. The enamelled wire according to claim 1, wherein the ratio between the $\alpha$-form $Al_2O_3$ particles and the $\gamma$-form $Al_2O_3$ particles is from 1:5 to 1:50.

7. The enamelled wire according to claim 6, wherein the ratio between the $\alpha$-form $Al_2O_3$ particles and the $\gamma$-form $Al_2O_3$ particles is from 1:5 to 1:15.

8. The enamelled wire according to claim 2, wherein the synthetic resin is selected from the group consisting of modified or unmodified polyacetal, polyurethane, polyester, polyesterimine, polyesterimide, polyimine, polyamideimide, polyamide, polysulfone, polyimide resins and mixtures thereof.

9. The enamelled wire according to claim 2, wherein the organic solvent is selected from the group consisting of cresols, hydrocarbons, dimethyl, phenol, toluene, xylene, ethylbenzene, N,N-dimethyl formamide, N-methylpyrrolidone, esters, ketones, and mixtures thereof.

10. The enamelled wire according to claim 2, wherein the coating composition comprises, based on the total weight of the synthetic resin and the organic solvent, from 80 to 20 wt % synthetic resin and from 20 to 80 wt % organic solvent.

11. The enamelled wire according to claim 10, wherein the coating composition comprises, based on the total weight of the synthetic resin and the organic solvent, from 75 to 25 wt % synthetic resin and from 25 to 75 wt % organic solvent.

12. The enamelled wire according to claim 1, wherein the particle size of the $Al_2O_3$ particles if from 0.01 to 5 microns.

* * * * *